US005724011A

United States Patent [19]

McWhirter et al.

[11] Patent Number: 5,724,011

[45] Date of Patent: Mar. 3, 1998

[54] VOLTAGE VARIABLE DIELECTRIC RIDGED WAVEGUIDE PHASE SHIFTER

[75] Inventors: Brian T. McWhirter, Redondo Beach; Steve K. Panaretos, Los Angeles, both of Calif.

[73] Assignee: Hughes Electronics, Los Angeles, Calif.

[21] Appl. No.: 711,725

[22] Filed: Sep. 3, 1996

[51] Int. Cl.[6] ..... H01P 1/18

[52] U.S. Cl. ..... 333/157; 333/34

[58] Field of Search ..... 333/34, 156–158, 333/995

[56] References Cited

U.S. PATENT DOCUMENTS

| | | | |
|---|---|---|---|
| 3,205,501 | 9/1965 | Kuhn | 333/158 |
| 3,555,463 | 1/1971 | Ogasawara et al. | 333/158 |
| 4,445,098 | 4/1984 | Sharon et al. | 333/158 X |
| 5,032,805 | 7/1991 | Elmer et al. | 333/156 |
| 5,206,613 | 4/1993 | Collier et al. | 333/157 X |
| 5,309,166 | 5/1994 | Collier et al. | 333/157 X |

*Primary Examiner*—Seungsook Ham

*Attorney, Agent, or Firm*—Leonard A. Alkov; Wanda K. Denson-Low

[57] ABSTRACT

A phase shifter employing a voltage variable dielectric material to add controlled phase delay in a ridged-waveguide section. The dielectric material has the property that its dielectric constant varies with changing electric field applied to the material. The dielectric material fills the ridge gap between the two waveguide ridges. An electrode is disposed within the dielectric material, and is connected to a variable voltage source to establish a transverse electrical field within the dielectric material. By varying the voltage, the magnitude of the field is varied, thereby allowing the phase delay of electromagnetic signals propagating through the waveguide section to be changed.

9 Claims, 2 Drawing Sheets

VOLTAGE VARIABLE DIELECTRIC RIDGED WAVEGUIDE PHASE SHIFTER

TECHNICAL FIELD OF THE INVENTION

This invention relates to the field of phase shifter elements useful in RF applications such as antenna array systems, and more particularly to a phase shifter employing a voltage variable dielectric material to add controlled phase delay in ridged-waveguide sections.

BACKGROUND OF THE INVENTION

Phase shifting devices in ridged-waveguide have been traditionally fabricated utilizing ferrite technology or through mechanical movement that results in a change of the propagation characteristics of the waveguide. Ferrite phase shifting devices have several disadvantages. They are expensive, occupy a large volume, and have significant weight. Mechanically actuated phase shifters have a slow response time, and are prone to failure.

For ridged-waveguide applications, a voltage variable dielectric phase shifter in accordance with this invention overcomes disadvantages of both the ferrite and mechanically-actuated phase shifters, and provides a light-weight, low-cost reliable means for adding phase delay.

SUMMARY OF THE INVENTION

A voltage variable dielectric ridged waveguide phase shifter is described, and includes a section of double ridged waveguide, having a conductive wall enclosing a waveguide channel. Opposed first and second conductive ridges extend into the channel and are separated by a ridge gap along a longitudinal extent of the waveguide section. A dielectric filler is disposed within the waveguide within the ridge gap, fabricated of a voltage variable dielectric material having the property that its dielectric constant value is dependent on a electric field established across the material. The phase shifter further includes a circuit for establishing a variable dc electric field across the dielectric filler to vary the dielectric field applied to the dielectric material. This in turn varies the dielectric constant value of the material and the resultant propagation delay of electromagnetic energy propagating along the longitudinal extent of the waveguide section.

In a preferred embodiment, the circuit for establishing the electric field comprises an electrode disposed within the dielectric filler, intermediately between the first and second ridges in the ridge gap, and a variable voltage source having a first polarity terminal connected to the electrode and a second polarity terminal electrically connected to the first and second ridges. The ridges act as electrodes in establishing one polarity of the electric field.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
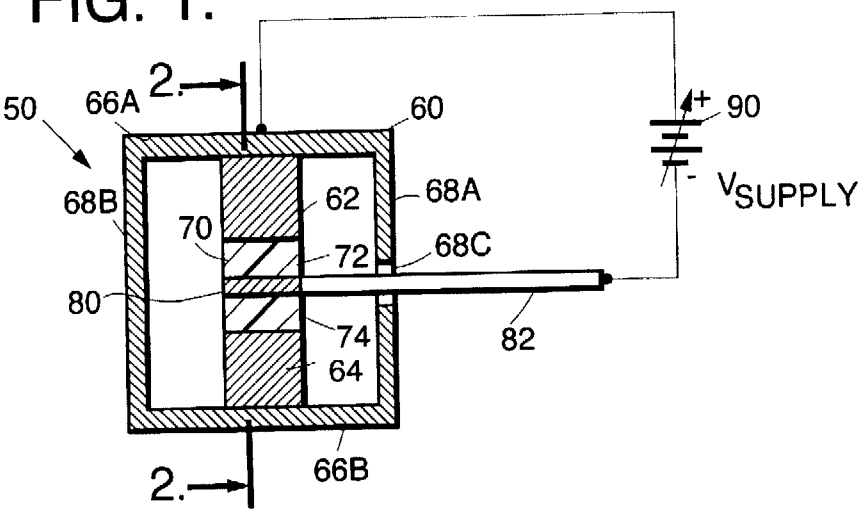
FIG. 1 is an end view of a simplified representation of a voltage variable dielectric phase shifter in accordance with the invention.
Figure 2:
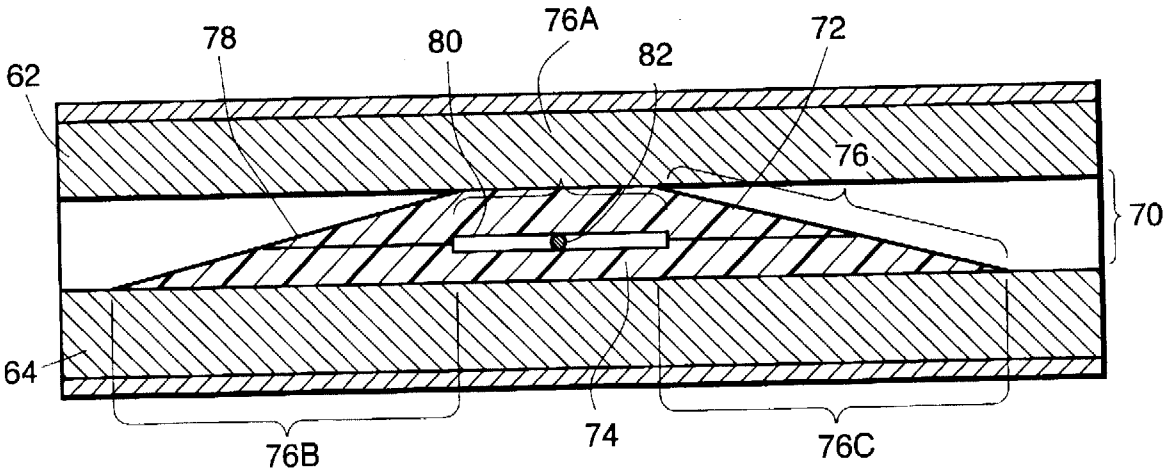
FIG. 2 is a side cross-sectional view of the phase shifter, taken along line 2—2 of FIG. 1.

FIGS. 1 and 2 illustrate an exemplary embodiment of a voltage variable phase shifter 50 embodying the invention. The phase shifter comprises a ridged-waveguide section 60, wherein ridges 62 and 64 extend from opposed side walls 66A, 66B of the section 60 to form a ridge gap 70.

Two equal height slabs 72, 74 of dielectric material are placed in the gap 70 to define a tapered dielectric structure 76. The structure 76 defines two impedance transformation sections 76B and 76C, which are smoothly tapered sections. The tapered sections gradually transform the impedance from that of the ridged waveguide section to that of the voltage variable phase shifter section. Without the impedance transformation sections 76B and 76C, there would be a large reflection at the phase shifter section. While the embodiment of FIGS. 1 and 2 employs a linearly tapered dielectric structure 76, the taper could alternatively be exponential, quadratic, or other forms of taper, depending on the requirements of a particular application.

The dielectric material from which the dielectric structure 76 is fabricated is selected such that its relative dielectric constant has the ability to change with an applied electric field by the amount necessary to provide the required phase shift. An exemplary dielectric material for this purpose is the ferro electric perovskite family, such as Barium Strontium Titanate (BST) ceramics, although in general any material that has a dielectric constant that varies with applied voltage will work.

A center electrode 80 is disposed along the joint line 78 at which the two dielectric slabs 72, 74 meet. The electrode is a flat conductive member which extends between the ridges 62, 64 at a gap region 70A which is fully filled by the dielectric slabs 72, 74. A dc connection is made to the electrode 80 by means of a wire 82, passed through a small opening 68C formed in side wall 68A of the waveguide 60. The opening 68C is made very small, only large enough to accomplish the function of allowing the wire to enter the conductive wall of the waveguide without contacting the wall. The minimization of the size of the opening is needed to minimize radiation from the opening. The wire 82 is connected to a variable voltage source 90, in order to apply a voltage between the electrode 70 and the waveguide 60, so that the ridges 62, 64 act as opposite polarity electrodes to the center electrode. For the exemplary dielectric material (BST), the voltage applied will typically be several thousand volts; an exemplary voltage range over which the voltage source 90 operates is 3000 v to 5000 v. As a result of changing the voltage applied to the center electrode, thereby changing the electric field between the center electrode and the ridges, the dielectric constant of the dielectric structure 76 is changed. The change in the dielectric constant changes the speed of propagation of electromagnetic energy through the dielectric structure, to effect a change in relative phase over the range of operation of the device.

Figure 3:
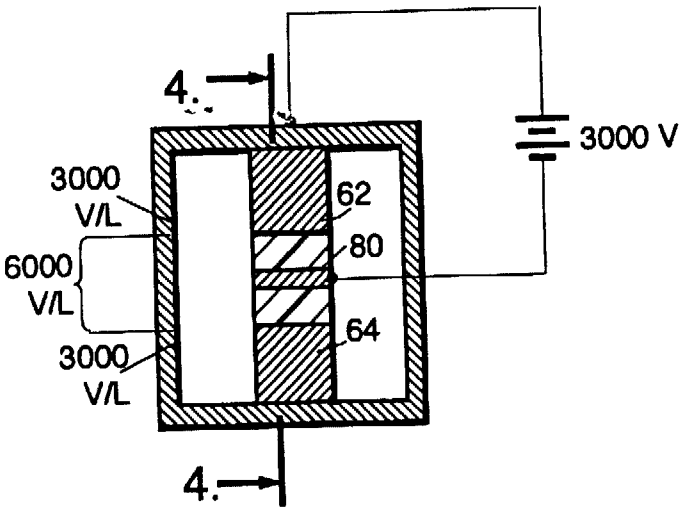
FIG. 3 is a simplified schematic diagram of the phase shifter of FIG. 1.

A feature of the embodiment of FIGS. 1 and 2 is that only a single dc connection is made to the center electrode, thus minimizing disturbances to the waveguide electromagnetic fields. Another advantage of the invention is that the magnitude of the necessary voltage applied between the center electrode and the two waveguide ridges to achieve a particular electric field is halved, as a result of using a center electrode as one polarity, and the two waveguide ridges as the second polarity electrode elements. This can be seen by the simplified schematic diagram of FIG. 3, wherein application of 3000 volts by the source results in an electric field of 3000 v/l (volts per unit length) in the region between the center electrode 80 and ridge 62, and an electric field of 3000 v/l in the region between the center electrode 80 and the second ridge 64. The effective electric field between the two ridges then is equivalent to 6000 v/l.

Figure 4:
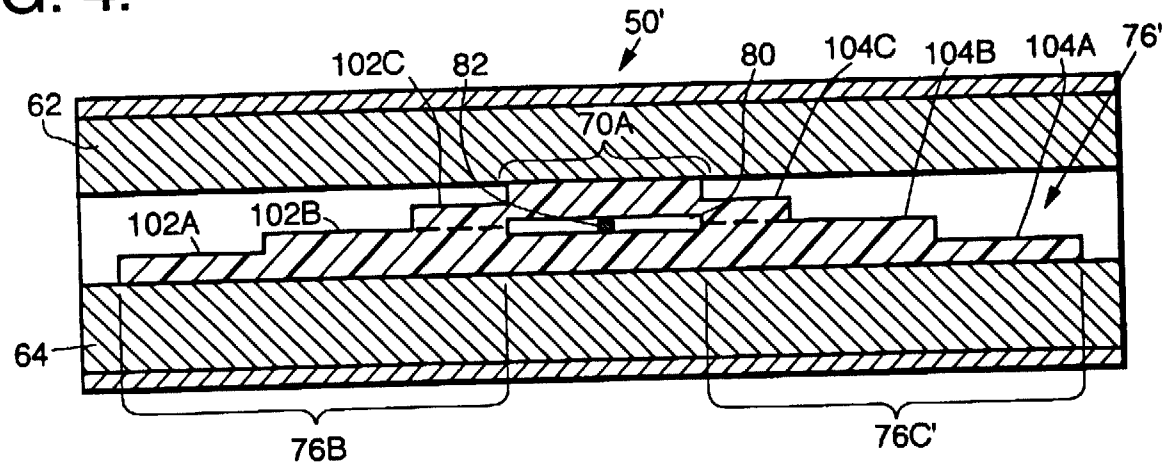
FIG. 4 is a side cross-sectional view of an alternate embodiment of a phase shifter in accordance with the invention, employing a stepped dielectric instead of a smoothly tapered dielectric as in the embodiment of FIG. 1.

FIG. 4 illustrates an alternate phase shifter 50' embodying the invention. This phase shifter is similar to the phase shifter 50 of FIGS. 1–3, except that the dielectric structure 76' includes stepped impedance transformation sections 76B' and 76C' instead of the smoothly tapered transformer sections 76B and 76C of phase shifter 50. Thus, section 76B' includes subsections 106A, 106B and 106C of three different thicknesses, and section 70C' includes subsections 104A, 104B and 104C of three different thicknesses. Of course, the number of impedance transformer steps can vary, depending on the requirements for a particular application. The stepped impedance transformer sections can often be used in applications requiring a very short phase shifter.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A voltage variable dielectric ridged waveguide phase shifter, comprising:

a section of double ridged waveguide, having a conductive wall enclosing a waveguide channel, and wherein opposed first and second conductive ridges extend into the channel and are separated by a ridge gap along a longitudinal extent of the waveguide section, wherein said section of double ridge waveguide has a longitudinal axis along which electromagnetic energy propagates, and an electric field is established along a direction which is transverse to said longitudinal axis;

a dielectric filler disposed within the waveguide within the ridge gap, said filler fabricated of a voltage variable dielectric material having a property that its dielectric constant value is dependent on an electric field established across the material, wherein the dielectric filler includes a first impedance transformer section which performs an impedance transforming function between an impedance of the waveguide section and an impedance of the phase shifter and wherein the dielectric filler includes a second impedance transformer section which performs an impedance transforming function between said impedance of the waveguide section and said impedance of the phase shifter, wherein the first and second impedance transformer sections are tapered along a longitudinal extent of the waveguide section at a first port of the phase shifter so as to gradually transform the impedance from that of a ridged waveguide section to that of a voltage variable phase shifter section, and wherein said voltage variable dielectric material is selected so that its relative dielectric constant has the ability to change with an applied electric field by an amount necessary to provide a predetermined phase shift;

a circuit for establishing a variable dc electric field across the dielectric filler to vary the electric field applied to the dielectric material and thereby vary the dielectric constant value of the material and the resultant propagation delay of electromagnetic energy propagating along the longitudinal extent of the waveguide section, said circuit comprising an electrode member disposed within the dielectric filler intermediately between the first and second ridges in the ridge gap, and a voltage source having a first polarity terminal connected to the electrode member and a second polarity terminal electrically connected to the first and second ridges, wherein the ridges act as electrodes of a second polarity in establishing the electric field, and a conductor element passed through a small opening in said conductive wall of the waveguide and in electric contact with said electrode member and with said first polarity terminal of said voltage source, and wherein only a single dc connection is made to said electrode member.

2. The phase shifter of claim 1 wherein the first impedance transformer section includes a first section of the dielectric filler having a plurality of discrete stepped thicknesses to transform from the impedance of the waveguide to the impedance of the phase shifter.

3. The phase shifter of claim 1 wherein the second impedance transformer section includes a second section of the dielectric filler having a plurality of discrete stepped thicknesses to transform from the impedance of the waveguide to the impedance of the phase shifter.

4. The phase shifter of claim 1 wherein the dielectric filler comprises first and second slabs of said dielectric material sandwiching said electrode member.

5. The phase shifter of claim 1 wherein the double ridged waveguide has a rectilinear cross-sectional configuration of opposed pairs of side walls.

6. The phase shifter of claim 1 wherein the voltage source is a variable voltage source.

7. The phase shifter of claim 1 wherein said dielectric filler is fabricated of a material in the ferro electric perovskite family.

8. The phase shifter of claim 7 wherein said voltage source provides a variable voltage in the range of about 1500 volts to about 3000 volts.

9. The phase shifter of claim 1 wherein said dielectric filler material is a Barium Strontium Titanate ceramic.

* * * * *